US005184887A

United States Patent [19]

O'Keefe et al.

[11] Patent Number: 5,184,887

[45] Date of Patent: Feb. 9, 1993

[54] DRAWER INTERLOCK SYSTEM

[75] Inventors: Lawrence J. O'Keefe, Grand Rapids; Michael J. Veihl, Spring Lake, both of Mich.

[73] Assignee: Herman Miller, Inc., Zeeland, Mich.

[21] Appl. No.: 852,888

[22] Filed: Mar. 17, 1992

Related U.S. Application Data

[63] Continuation of Ser. No. 604,126, Oct. 26, 1990, abandoned.

[51] Int. Cl.[5] ..... E05C 7/06

[52] U.S. Cl. ..... 312/221; 312/219; 70/71

[58] Field of Search ..... 312/216, 217, 218, 219, 312/220, 221; 70/78, 80, 81; 292/DIG. 18

[56] References Cited

U.S. PATENT DOCUMENTS

| | | | |
|---|---|---|---|
| 1,686,194 | 10/1928 | Wheary et al. . | |
| 2,653,070 | 9/1953 | McClellan . | |
| 2,709,123 | 5/1955 | Woina . | |
| 2,789,876 | 4/1957 | Heilman et al. . | |
| 2,886,392 | 5/1959 | Stegmaier | 312/217 |
| 2,966,384 | 12/1960 | Bergman . | |
| 3,259,444 | 7/1966 | Friend . | |
| 3,323,849 | 6/1967 | Stark . | |
| 3,539,236 | 11/1970 | Miller . | |
| 3,622,216 | 11/1971 | Haunost . | |
| 3,774,985 | 11/1973 | Chovanec et al. . | |
| 3,866,993 | 2/1975 | Dean et al. . | |
| 3,883,200 | 5/1975 | Latham . | |
| 3,900,236 | 8/1975 | Goulish et al. . | |
| 3,909,090 | 9/1975 | Breckner et al. . | |
| 3,936,108 | 2/1976 | Chitester . | |
| 3,969,008 | 7/1976 | Pergler . | |
| 4,239,309 | 12/1980 | De Fouw et al. | 312/221 |
| 4,298,236 | 11/1981 | Laroche . | |
| 4,355,851 | 10/1982 | Slusser | 312/221 X |
| 4,429,930 | 2/1984 | Blouin . | |
| 4,453,787 | 6/1984 | Staropoli . | |
| 4,480,883 | 11/1989 | Young . | |
| 4,768,844 | 9/1988 | Ludwig | 312/221 |
| 4,957,334 | 9/1990 | Lakso | 312/221 |
| 4,966,423 | 10/1990 | Higuera et al. | 312/219 X |
| 4,993,784 | 2/1991 | Dana et al. | 312/221 |
| 5,074,627 | 12/1991 | Broeders | 312/218 X |

FOREIGN PATENT DOCUMENTS

| | | | |
|---|---|---|---|
| 1013203 | 12/1965 | United Kingdom | 70/81 |
| 2220026 | 12/1989 | United Kingdom | 70/78 |

*Primary Examiner*—James R. Brittain
*Assistant Examiner*—Brian K. Green
*Attorney, Agent, or Firm*—Varnum, Riddering, Schmidt & Howlett

[57] ABSTRACT

A lock for an interlock mechanism that prevents the opening of more than one filing cabinet drawer at a time. The interlock mechanism comprises a fixed-length channel having at least one movable block and at least two wedges. When a drawer is opened, one of the wedges is moved, thereby filling the channel and preventing the opening of another drawer. The lock selectively prevents the wedges from moving into the channel when all of the drawers are closed, thereby locking all of the drawers in the filing cabinet in a closed position.

13 Claims, 3 Drawing Sheets

DRAWER INTERLOCK SYSTEM

This is a continuation of application Ser. No. 604,126, filed Oct. 26, 1990, now abandoned.

BACKGROUND OF THE INVENTION

1. Field of the Invention

This invention relates to filing cabinets incorporating a drawer interlock system which prevents the simultaneous opening of more than one file drawer and which further permits all the drawers in the cabinet to be locked in a closed position.

2. Description of the Related Art

In U.S. Pat. No. 4,355,851, to Slusser, issued Oct. 26, 1982, there is disclosed and claimed an interlock mechanism which prevents the simultaneous opening of more than one file drawer in a filing cabinet Although this interlock successfully prevents simultaneous opening of more than one drawer, there is no disclosed mechanism for locking all drawers in a closed position It is often desired to lock all the filing cabinet drawers in a closed position to protect unauthorized entry into the cabinet and secure important documents and other materials.

Locking systems for locking drawers in a closed position are well known, even in those systems which prevent the opening of more than one drawer at a time. None of these systems appears to be adaptable to the Slusser interlock system. Further, the drawer lock systems are typically separate from the interlock systems.

SUMMARY OF THE INVENTION

The invention relates to a drawer interlock system for a filing cabinet having a housing, at least two drawers, and means for mounting the drawers to the cabinet housing for glided movement into and out of the housing. The interlock mechanism prevents more than one drawer from being opened at the same time and has locking means for selectively locking all of the drawers in the file cabinet housing in the closed position.

The interlock mechanism comprises an elongated channel mounted to a cabinet side wall. The channel has stops placed in its ends to fix the length of the channel and at least one block is slidably mounted in the channel, that block having at least one end surface that is at an acute angle relative to the bottom wall of the channel. Further, the interlock mechanism comprises wedge members that are mounted for lateral translational movement at least partially into and at least partially out of the channel as one of the drawers is opened and closed respectively. The sides of the block and wedges are configured such that the elongate channel is filled when one of the wedges moves into the channel as a drawer is being opened. This movement of one of the wedges into the elongate channel prevents another drawer from being opened after the previous drawer has been opened. When all of the drawers are closed, a predetermined gap is present in the elongate channel.

The improvement of this invention comprises a locking means that selectively prevents movement of the wedge members into the elongate channel when the drawers are closed, thus locking all of the drawers in the file cabinet housing.

In one embodiment, the locking means comprises a movable locking block that is mounted in the elongate channel for movement between a locked position at one end of the channel and an unlocked position that is spaced from the end of the channel, thereby forming a predetermined space or gap between the end of the channel and the movable stop block. Further, the locking means can comprise a locking bar slideably mounted with respect to the elongate channel for movement between a locked and an unlocked position. The latch includes a flange for selectively blocking movement of the movable locking block from the unlocked position to the locked position when the locking bar is in the locked position. The locking means can also include a key operated cylinder lock that is mounted to a front wall of the cabinet and means coupling the cylinder lock to the slideably mounted locking bar.

BRIEF DESCRIPTION OF THE DRAWINGS

The invention will be described with reference to the accompanying drawings wherein like members bear like reference which.

DETAILED DESCRIPTION OF THE PREFERRED EMBODIMENT

Figure 1:
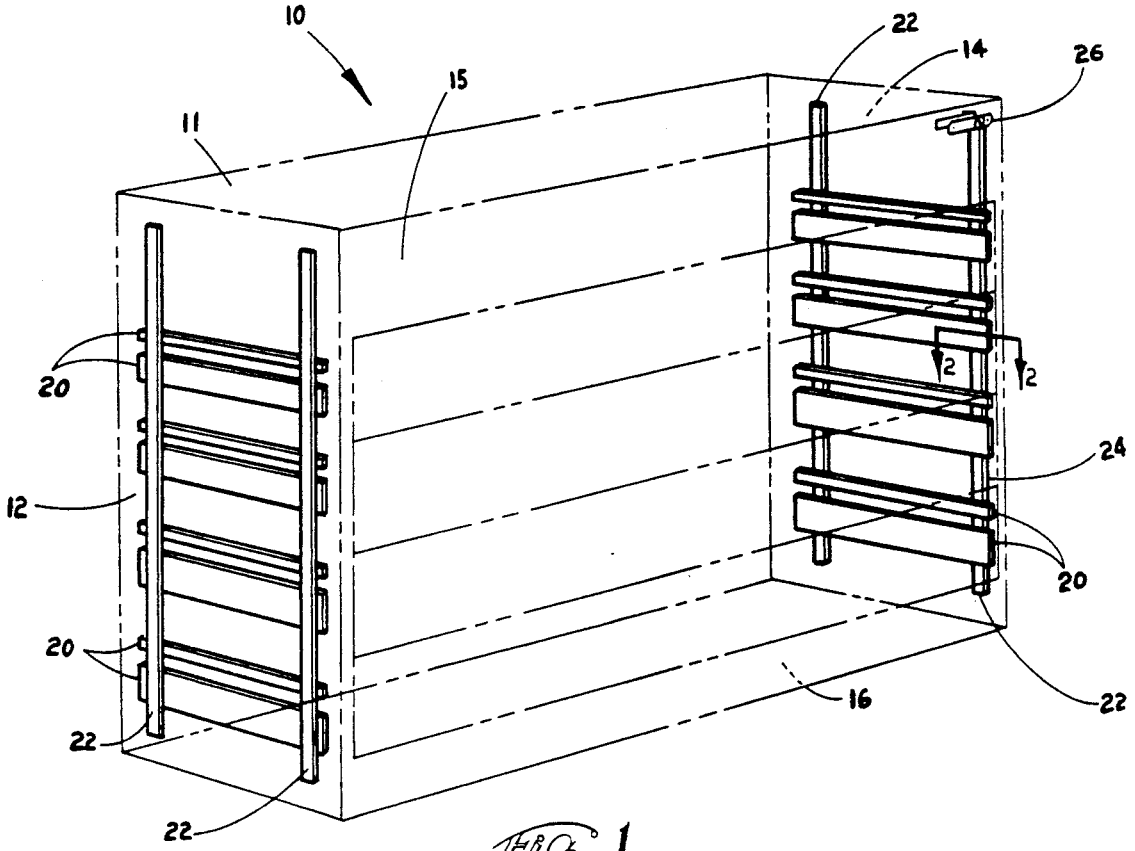
FIG. 1 is a perspective view of a filing cabinet including a drawer mechanism and locking means according to the FIG. 2 is a cross-sectional view taken along lines 2—2 of FIG. 1 showing a pick-up mechanism and wedge member for the interlock mechanism according to the invention with the drawer in a position.

With reference to FIGS. 1–9, an interlock system for a cabinet comprising an interlock mechanism and a locking means is shown. As shown in FIG. 1, a filing cabinet 10 or the like includes a housing 11 having side walls 12 and 14, a front wall 15, and a base 16. Mounted within the cabinet 10 are a plurality of drawers 18 which are slidably mounted in the housing 11 on conventional drawer glides 20 secured to the side walls 12 and 14 of the cabinet 10 by means of frames 22. By mounting the glides 20 to the frames 22, the drawer glides and the interlock mechanism to be described below may be secured to the side walls of the cabinet in a relatively easy fashion. Alternatively, the drawer glides and interlock mechanism may be mounted directly to the cabinet side walls. Also shown is a lock means 26 mounted to the front wall 15 of the cabinet.

The interlock mechanism is of the type disclosed and claimed in the aforementioned Slusser U.S. Pat. No. 4,355,851, which is incorporated herein by reference and which is best shown in FIGS. 2–7. Mounted to the drawer glides 20 is an elongated channel 24 which can be stamped or fabricated from sheet metal or the like or can be made of plastic.

The channel 24 has a shallow U-shaped cross-sectional configuration comprising a bight portion 28 and parallel legs 30, thus giving the channel a cavity of fixed depth. Extending from one of the legs 30 are flanges 32 which are parallel to and spaced away from the bight portion 28. The channel 24 is secured to the frame 22 by screws 34 which extend through the flanges 32.

The length of the channel 24 is substantially equal to the height of the stack of drawers 18. At the lower end of the channel 24, in the cavity formed by the legs 30 and bight portion 28 thereof, is a lower fixed stop member 36 which is fixedly attached to the channel 24 by suitable means such as a screw 38. Also mounted in the cavity of the channel 24 are wedge members 40, and floating blocks 42. The wedge members have a recess 46 and a surface 44 which is at an acute angle with respect to the longitudinal axis of the channel 24. The recess 46 is formed within the body of the wedge member 40. Wedge members are preferably constructed of a suitable plastic material. The wedges 40 have a width less than the width of the channel 24 such that a space 49 exists between the opposing legs 30 and the sides of the wedges 40. In this way, the wedges 40 are laterally slidable in the channel and can be forced deeper into the channel and stack of floating blocks 42 and wedges 40 in a manner to be described below. Interspaced between the wedge members 40 are floating blocks 42. Each block incorporates an edge 48 which is at an acute angle with respect to the longitudinal axis of the channel 24, and which is complementary to the angled edge 44 of wedge member 40. The width of the floating block 42 is slightly less than the width of the channel 24 created by the legs 30.

The wedge members 40 and floating blocks 42 are arranged in the channel according to the number of drawers 18 included in the cabinet 10, such that a wedge member 40 is incorporated in the channel 24 for each of the drawers 18. At the bottom of the channel 24, the lower fixed stop 36 is fixedly attached. A wedge member 40 rests on top of the lower fixed stop 36 such that the acutely angled edge 44 is the top surface of the wedge 40. A floating block 42 is inserted into the channel 24 above the lower most wedge member 40 such that the complementary acutely angled edge 48 rests upon the acutely angled edge 44 of the wedge member 40. Another wedge member 40 is inserted into the channel 24 such that it rests on top of the floating block 42 and the acutely angled edge 44 is the top surface. A floating block 42 is next inserted into the channel such that the acutely angled edge 48 of the block is in contact with the acutely angled edge 44 of the wedge. This stacking arrangement is repeated for each drawer 18 in the stack. Mounted on top of the wedge member 44 corresponding to the top drawer 18 is a locking block 50. The locking block 50 has an acutely angled edge 52 and a top edge 54 which is substantially perpendicular to the longitudinal axis of the channel 24.

The drawer interlock mechanism incorporates a U-shaped pick-up 56 and a cam 58. The pick-up 56 and cam 58 rotate about a pivot pin 60 to which the pick-up 56 and cam 58 are fixedly attached. The cam 58 and pick-up 56 are attached to the channel 24 by a mounting bracket 62. The mounting bracket 62 is fixedly attached to the flange 32 by suitable means such as rivets 64. The pivot pin 60 passes through an opening (not shown) in the mounting bracket 62. The pick-up 56 and cam 58 are fixedly mounted to the pin 60 such that the cam 5-8 is on one side of the bracket 62 and the cam 58 is on the other. The mounting bracket 62 is attached to the channel 24 and flange 32 at a point such that the cam 58 is mounted within the recess 46 of wedge member 40. A mounting bracket 62, a pick-up 56 and a cam 58 are provided for each drawer 18 in the cabinet 10.

Figure 2:
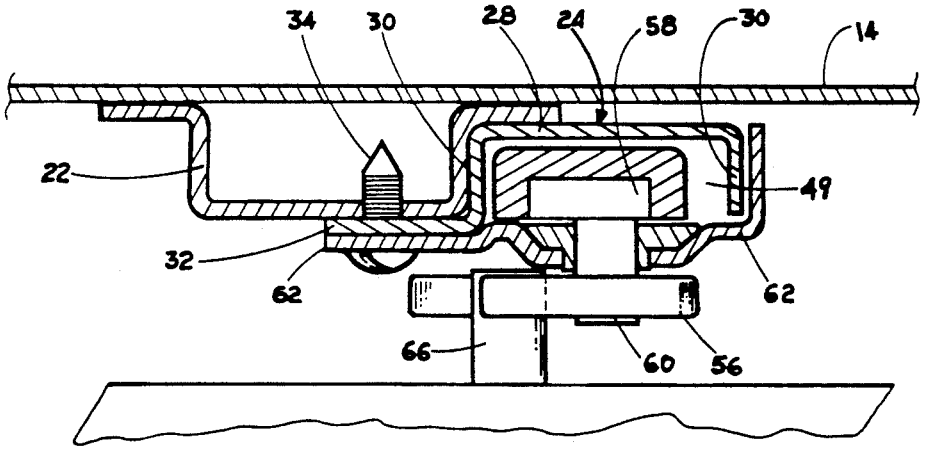
Figure 4:
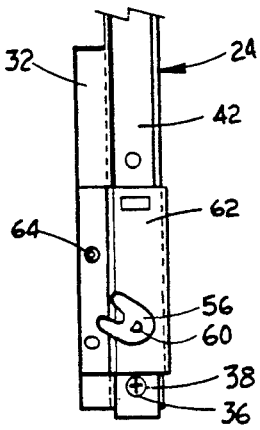
FIG. 4 is a partial view of a single pick-up mechanism for a drawer in the closed position.
Figure 5:
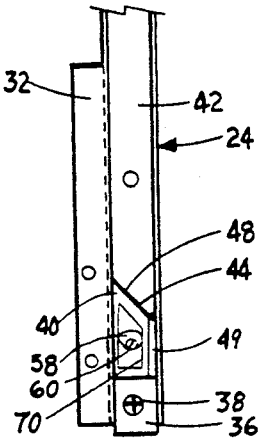
FIG. 5 is a enlarged partial view like FIG. 3 of the wedge member and cam of the pick-up mechanism of a single drawer in closed position.

As seen in FIGS. 4 and 5, when the drawer is closed, the opening of the U-shaped pick-up 56 is directed toward the rear of the cabinet 15 so that it can receive a drawer stud 66 (FIG. 2). In this position, the wedge 40 is positioned toward the rear of the cabinet 11 and the channel 24.

Figure 6:
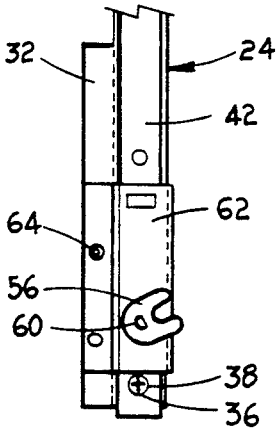
FIG. 6 is a partial view like FIG. 4 of a single pick-up mechanism for a drawer in the open position.
Figure 7:
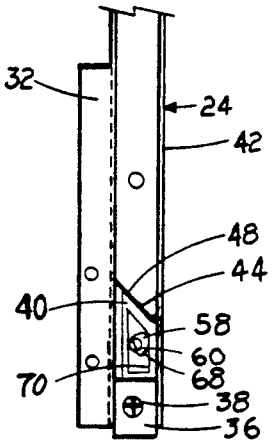
FIG. 7 is a partial view like FIG. 5 of the wedge member and cam of the pick-up mechanism of a single drawer in the open position.

As seen in FIGS. 6 and 7, when the drawer 18 is pulled out from the cabinet 10, the drawer stud 66 (FIG. 2) contacts the U-shaped pick-up 56 and causes it and the cam 58 to pivot about pivot pin 60. The rotating motion of cam 58 causes a biased edge 68 of the cam 58 to rotate about the pivot pin 60 and contact a rotating surface 70 of the recess 60 of the wedge member 40. The force applied by the biased edge 68 of the cam 58 on the rotating surface of the wedge 70 causes the wedge 40 to slide laterally toward the front of the cabinet 10 within the channel 24 into space 49. This movement of the wedge 40 results in the acutely angled edge of the wedge 44 sliding along the acutely angled edge 48 of the block 42. The sliding movement along these complemen-tary surfaces lifts the stack of wedges and blocks above the drawer 18 which is being opened. The top edge 54 of the locking block 50 contacts an upper stop means 72. The stack of wedges and blocks remains in this raised position until the drawer is closed, where upon the stack of wedges and blocks return to the lower position illustrated in FIG. 3.

Figure 8:
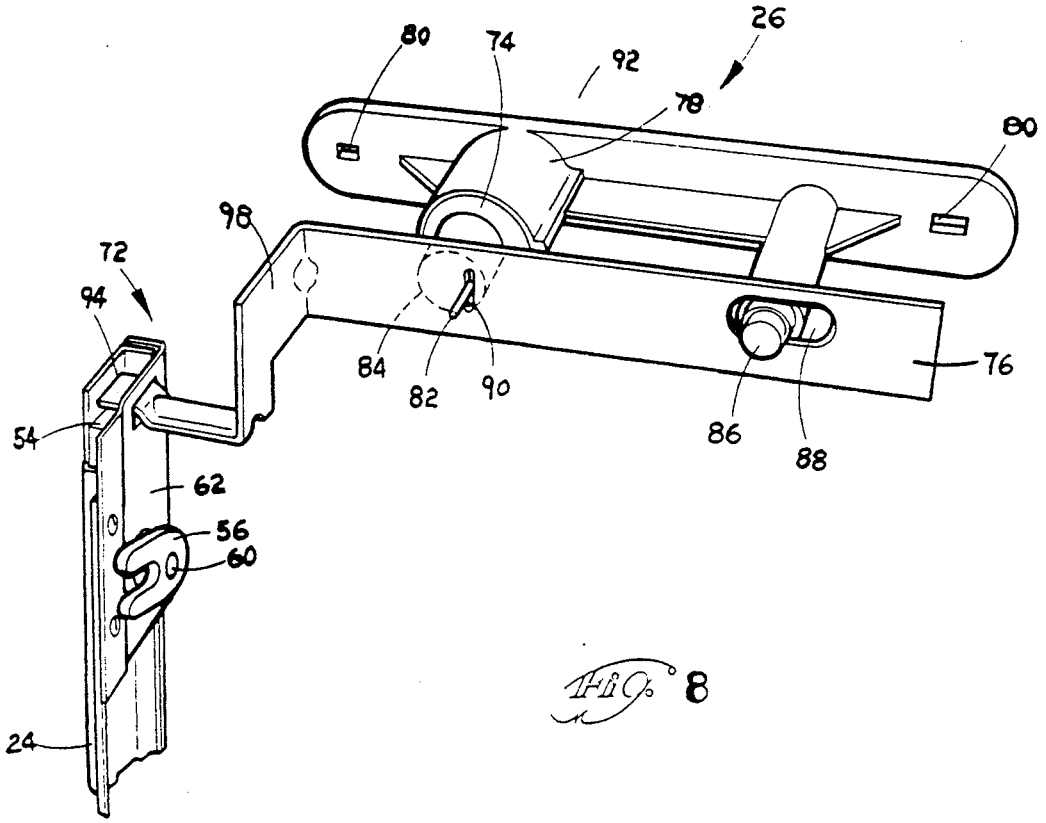
FIG. 8 is a perspective view of the top portion of the elongated channel and the locking means in the unlocked position.
Figure 9:
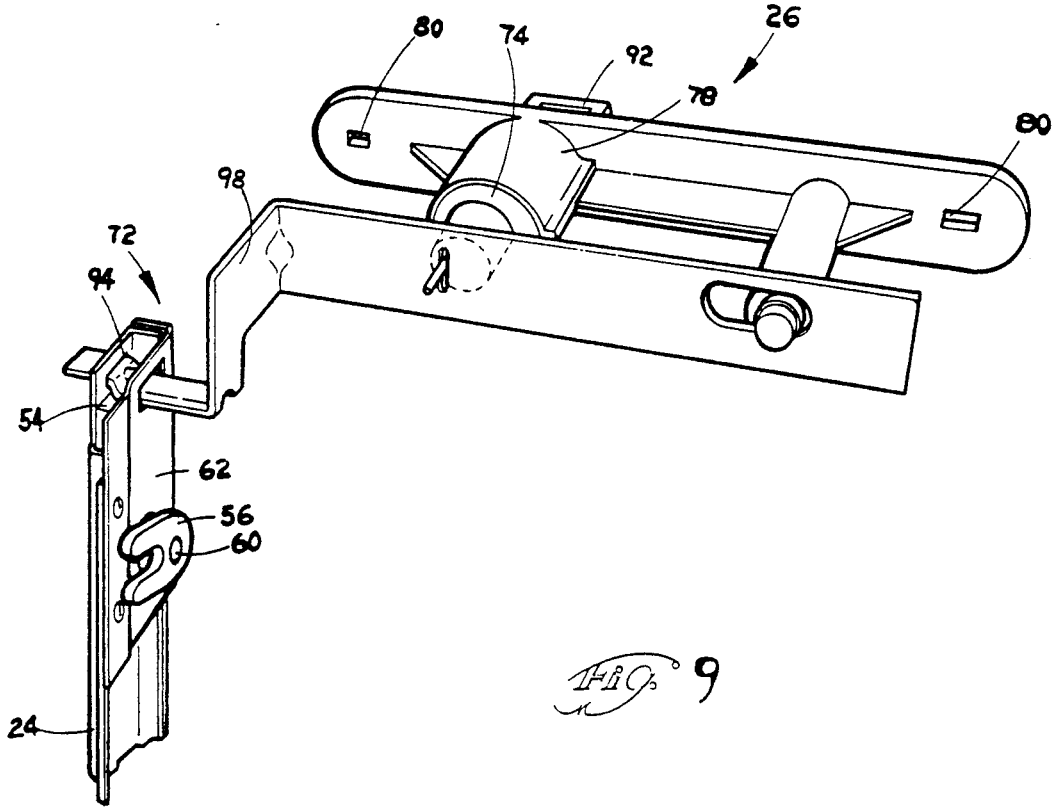
FIG. 9 is a perspective view of the top portion of the elongated channel and the locking means in the locked position.

As seen in FIGS. 8 and 9, the upper stop means 72 comprises a conventional lock mechanism 74 and a locking bar 76. The lock mechanism 74 is mounted in a lock housing 78. The lock housing 78 has openings 80 for mounting the housing to the front wall 15 of the cabinet 10. The housing 78 is mounted by screws (not shown) or by other suitable means.

A rotating peg 82 is mounted near the edge of a circular rotating drum 84 of the lock mechanism 74. The peg 82 and drum 84 extend from the rear of the lock mechanism 74 and lock housing 78. A slide post 86 also extends from the rear of the lock housing 78. Preferably, the lock housing 78 and slide post 86 are an integrally molded plastic part.

The slide post 86 extends through an elongated opening 88 of the locking bar 76. The longitudinal axis of opening 88 is parallel to the longitudinal axis of the locking bar 76. The locking bar 76 also contains a narrow peg opening 90. The rotating peg 82 of the lock mechanism 74 extends through this peg opening 90 creating a sliding connection which interconnects the cylinder lock mechanism 74 and the locking bar 76. The longitudinal axis of the peg opening 90 is to the longitudinal axis of opening 88 and the locking bar 76.

The lock means 26 in its assembled state is arranged such that the slide post 86 extends through elongated opening 88 and rotating peg 82 extends through peg opening 90. When a key 92 for the lock mechanism 74 is rotated, the peg 82 and drum 84 are also rotated. Because the peg 82 is mounted near the edge of the diameter of the drum 84, the peg 82 travels in an arc as the drum 84 rotates. The peg opening 90 is long enough such that the peg 90 slides along the length of the opening as it is rotated by the key 92 and rotating drum 84. The rotation of the peg 82 around the diameter of the drum 84 causes the locking bar 76 to slide from side to side. The locking bar 76 moves from an unlocked position, shown in FIG. 8 to a locked position, shown in FIG. 9.

Figure 3:
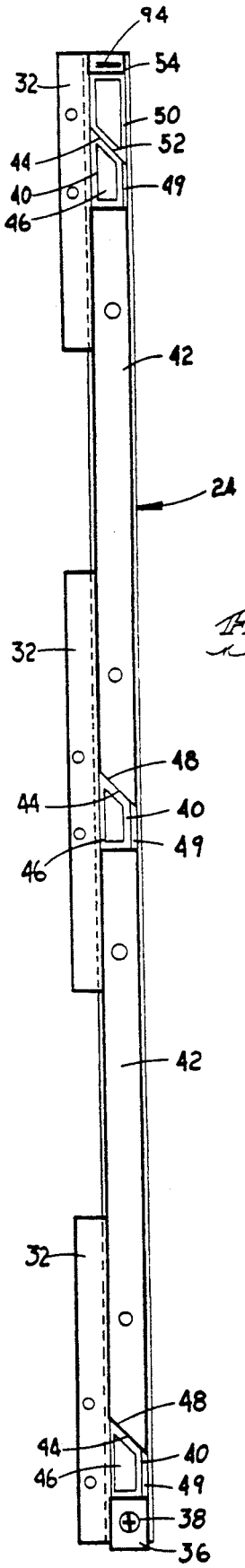
FIG. 3 is a detailed view of an elongated channel of the interlock mechanism shown in FIG. 1 with the drawers in the closed position and including wedge members, blocks, cam members, and a movable stop block, and with the locking means removed for clarity.

The lock means 26 interacts with the stack of blocks and wedges within the elongated channel to prevent opening of a drawer 18 while the cabinet 10 is locked. As seen in FIG. 3, the portion of the elongated channel which receives the wedges 40 floating blocks 42 and locking block 50 is of a defined length. This length is defined by the lower fixed stop 36 and a flange at the top of the channel 24. As seen in FIGS. 8 and 9, the slot 94 receives the flange.

The locking bar 76 is one component of the lock means 26. At one end of the locking bar 76 is an arm 98. The arm extends toward the rear of the cabinet 10. At the lower edge of the arm 98, a flange, having a first surface 96 and a second surface 100, forms one of the stops in the end of the elongated channel 24. The first surface 96 is spaced vertically from the second surface 100.

As seen FIG. 8, when the cabinet 10 is in the unlocked position and all drawers are closed, the first surface 96 is above the locking block 50 such that a gap 102 exists between the top edge 54 of locking block 50 and the locking flange 96. Gap 102 is substantially equal to the distance which the floating blocks 42 wedges 46 and locking block 50 are raised when a single drawer 18 is open. As described earlier, when a drawer is open, the corresponding wedge 40 slides laterally toward the front of the cabinet within the channel 24, causing the floating blocks 42, wedges 40 and locking block 50 above the drawer being opened to slide upward a short distance. When one drawer is open, the top surface 54 of locking block 50 is in contact with the first surface 96. If the operator attempts to open a second drawer, the wedge 40 corresponding to that drawer is blocked from sliding laterally forward within the channel 24, and thereby preventing the pick-up 56 and cam 58 from pivoting. Thus, the second drawer is blocked from opening.

When the cabinet 10 is to be locked, as seen in FIG. 9, the locking bar 76 slides toward the elongated channel 24, assuming all drawers are closed. This movement causes the second surface 100 of the locking bar 96 to slide into the position immediately above the top surface 54 of the locking 50. The second surface 100 eliminates gap 102 because it is in contact with the top surface 54. In this position, the stack of wedges 40 for the drawers in the closed position, and the floating blocks 42 and locking block 50 occupy the entire length of the elongated channel 24 between the lower stop member 36 and the ribbed flange 100. Therefore, no drawers may be opened because the wedge 40 corresponding to each of the drawers 18 is prevented from sliding laterally forward within the channel.

Applicant's invention improves upon a drawer interlock mechanism by adding the ability of locking the entire stack of cabinet drawers by an easily installed, interactive locking mechanism. Applicant's invention combines these desired features with minimal modifications to the known drawer interlock mechanisms.

While particular embodiments of the invention have been shown, it will be understood that the invention is not limited thereto and reasonable modifications and variations are possible without departing from the spirit of the invention.

The embodiments of the invention in which an exclusive property or privilege is claimed are defined as follows:

1. In a cabinet including a housing having at least two drawers, means mounting the drawers to the housing for glided movement into and out of the housing, and an interlock mechanism for preventing more than one drawer from opening at one time, the interlock mechanism comprising:

an elongated channel mounted to a side wall of the cabinet and having ends with stops to fix the lengths thereof;

at least one block slidably mounted in the channel, the at least one block having at least one end surface at an acute angle relative to a bottom wall of the channel;

wedge members stacked within the channel in vertical alignment with the at least one block and individually mounted for lateral translational movement within the channel relative to said stack of wedge members as one of the drawers is opened and closed respectively, the size of the at least one block and the wedges being such that the elongate channel is filled when one of the wedges moves laterally within the elongate channel as a drawer is opened to prevent another drawer from opening when the one drawer is opened, and such that a predetermined gap is present in the elongate channel when the drawers are closed;

the improvement which comprises:

a movable locking block mounted in the elongate channel for vertical movement; and, a lock having a locking bar with a flange having a first and second surface, said first surface being vertically spaced from said second surface, said surfaces selectively forming one of the stops in the elongate channel, said locking bar being laterally movable so that the first surface provides a predetermined gap for movement of the locking block in an unlocked position of the locking bar and the second surface occupies the predetermined gap in a locked position of the locking bar to prevent movement of the locking block whereby the locking bar selectively prevents movement of the wedge members laterally within the elongate channel to selectively lock all of the drawers in the housing.

2. A cabinet according to claim 1 wherein the lock further comprising;

a cylinder lock which rotates about an axis of rotation; and a sliding connection inter-connecting the cylinder lock and the locking bar such that the locking bar moves in a direction transverse to said axis of rotation as the cylinder lock is rotated from a locked to an unlocked position.

3. A cabinet according to claim 2 wherein said cylinder lock is mounted to an outside wall of the cabinet.

4. A cabinet according to claim 3 wherein the cylinder lock is a key lock.

5. A cabinet according to claim 4 wherein the cylinder lock is mounted to a front wall of the cabinet.

6. In a cabinet having at least two drawers movable between open and closed positions in the cabinet and an interlock mechanism for preventing the opening of more than one drawer at a time, wherein the interlock mechanism has a fixed-length channel with at least one movable block and at least two wedges stacked within the channel in vertical alignment with the at least one block, one of the wedges is moved laterally within the stack with the opening of a drawer to fill a predetermined gap in the channel and thereby prevent another drawer from opening, the improvement which comprises:

a movable locking block mounted in the fixed-length channel for vertical movement; and a lock having a movable locking bar with a flange having a first surface and a second surface, said first surface being vertically spaced from said second surface, said surfaces selectively forming a stop in the fixed-length channel, said locking bar being laterally movable so that the first surface provides a predetermined gap for movement of the locking block in an unlocked position of the locking bar and the second surface occupies the predetermined gap in the locked position of the locking bar to prevent movement of the locking block whereby the locking bar selectively prevents the wedges from moving laterally within the channel to selectively prevent opening of any of the drawers.

7. A cabinet according to claim 6 wherein the lock further comprises:

a cylinder lock which rotates about an axis of rotation and said locking bar is inter-connected to said cylinder lock such that the locking bar moves in a direction transverse to said axis of rotation as the cylinder lock is rotated from a locked to an unlocked position.

8. A cabinet according to claim 7 wherein said cylinder lock is mounted to an outside wall of the cabinet.

9. A cabinet according to claim 8 wherein the cylinder lock is a key lock.

10. A cabinet according to claim 9 wherein the cylinder lock is mounted to a front wall of the cabinet.

11. In a cabinet having at least two drawers movable between open and closed positions in the cabinet and an interlock mechanism for preventing the opening of more than one drawer at a time, wherein the interlock mechanism has a fixed-length channel with movable blocks and wedges vertically aligned and stacked in the channel and which are moved with the opening of one drawer to fill the channel and thereby prevent other drawers from opening, the improvement which comprises:

a movable locking block mounted in the elongate channel for movement;

a cylinder lock which rotates about an axis of rotation;

a locking bar;

a sliding connection inter-connecting the cylinder lock and the locking bar such that the locking bar moves in a direction transverse to said axis of rotation as the cylinder lock is rotated from a locked to an unlocked position; and a flange muted to the locking bar, the flange having a first surface and a second surface, said first surface being vertically spaced from said second surface, said surfaces selectively forming a stop in the fixed-length channel so that the first surface provides a predetermined gap in the channel in the unlocked position and the second surface occupies the predetermined gap in the locked position;

whereby selective movement of the locking bar into the locked position selectively blocks all of the drawers i the cabinet in the closed position.

12. In a cabinet including a housing having at least two drawers, means mounting the drawers to the housing for glided movement into and out of the housing, and an interlock mechanism for preventing more than one drawer from opening at one time, the interlock mechanism comprising:

an elongate channel mounted to a side wall of the cabinet and having ends with stops to fix the length thereof;

at least one block slidably mounted in the channel, the block having at least one end surface at an acute angle relative to a bottom wall of the channel;

wedge members stacked within the channel in vertical alignment with the block and individually mounted for lateral translational movement within the channel relative to said stack of wedge members as one of the drawers is opened and closed respectively, the size of the at least one block and the wedges being such that the elongate channel is filled when one of the wedges moves laterally within the elongate channel as a drawer is opened to prevent another drawer from opening when the one drawer is opened, and such that a predetermined gap is present in the elongate channel when the drawers are closed;

the improvement which comprises:

a lock for selectively preventing movement of the wedge members laterally within the elongate channel by occupying said predetermined gap when the drawers are closed to selectively lock all of the drawers in the housing said lock comprising:

a cylinder lock which rotates about an axis of rotation;

a locking bar;

a sliding connection inter-connecting the cylinder lock and the locking bar such that the locking bar moves in a direction transverse to said axis of rotation as the cylinder lock is rotated from a locked to an unlocked position;

an eccentrically mounted peg which extends from a rear surface of the cylinder lock parallel to said axis of rotation;

an elongated opening in the locking bar which extends in a direction transverse to a longitudinal axis of the locking bar and slidably receives the peg; and a flange mounted at an end of the locking bar which selectively occupies said predetermined gap as the cylinder lock and locking bar are moved from the unlocked to the locked position.

13. In a cabinet having at least two drawers movable between gas and closed positions in the cabinet and an interlock mechanism for preventing the opening of more than one drawer at a time, wherein the interlock mechanism has a fixed-length channel with at least one movable block and at least two wedges stacked within the channel in vertical alignment with the block, one of the wedges is moved laterally within the stack with the opening of a drawer to a predetermined gap in the channel and thereby prevent another drawer from opening, the improvement which comprises;

a lock for selectively preventing the wedges from moving laterally within the channel when all drawers are closed to selectively prevent opening of any of the drawers, said lock comprises;

a cylinder lock mounted to the cabinet and which rotates about an axis of rotation;

a locking bar which is inter-connected to said cylinder lock such that it moves in a direction transverse to said axis of rotation as the cylinder lock is rotated from a locked to an unlocked position;

an eccentrically mounted peg which extends from a rear surface of the cylinder lock parallel to said axis of rotation; and an elongated opening in the locking bar and which extends in a direction transverse to a longitudinal axis of the locking bar and slidably receives the peg:

a flange mounted at an end of the locking bar and which selectively occupies said predetermined gap as the cylinder lock and locking bar are moved from the unlocked to the locked position.

* * * * *

UNITED STATES PATENT AND TRADEMARK OFFICE

CERTIFICATE OF CORRECTION

PATENT NO. : 5,184,887

DATED : February 9, 1993

INVENTOR(S) : LAWRENCE J. O'KEEFE and MICHAEL J. VEIHL

It is certified that error appears in the above-identified patent and that said Letters Patent is hereby corrected as shown below:

Claim 1, Col. 6, line 12, "elongated" should be --elongate--.

Claim 1, Col. 6, line 14, "lengths" should be --length--.

Claim 2, Col 6, line 51, "comprising" should be --comprises--.

Claim 11, Col. 7, line 61, "muted" should be --mounted--.

Claim 11, Col. 8, line 3, "i" should be --in--.

Claim 13, Col. 8, line 57, "gas" should be --open--.

Claim 13, Col. 8, line 64, after "drawer to" insert --fill--.

Signed and Sealed this

Twenty-third Day of November, 1993

Bruce Lehman

*Attest:*

BRUCE LEHMAN

*Attesting Officer*

*Commissioner of Patents and Trademarks*